United States Patent [19]

Witchell

[11] B 4,015,654

[45] Apr. 5, 1977

[54] ADJUSTABLE TOOLING METHOD AND APPARATUS FOR INVESTMENT PATTERNS

[75] Inventor: John B. Witchell, Pierrefonds, Canada

[73] Assignee: United Aircraft of Canada Limited, Longueuil, Canada

[22] Filed: Feb. 3, 1975

[21] Appl. No.: 546,677

[44] Published under the second Trial Voluntary Protest Program on April 6, 1976 as document No. B 546,677.

[52] U.S. Cl. ..... 164/4; 164/45; 164/154

[51] Int. Cl.[2] ..... B22C 7/00

[58] Field of Search ..... 164/4, 45, 46, 154, 164/235, 237, 238; 249/155, 159; 425/175, 180

[56] References Cited

UNITED STATES PATENTS

| | | | |
|---|---|---|---|
| 2,503,630 | 4/1950 | Norton | 164/45 X |
| 2,752,653 | 7/1956 | Emblem et al. | 164/45 |
| 3,669,589 | 6/1972 | Bordat | 249/159 X |
| 3,848,654 | 11/1974 | Boyle et al. | 164/45 X |

*Primary Examiner*—J. Howard Flint, Jr.
*Assistant Examiner*—John E. Roethel
*Attorney, Agent, or Firm*—A. W. Breiner

[57] ABSTRACT

A pattern representing the airfoil section of a stator vane is located on a supporting block adapted to be received in a casting fixture. A locating block is also provided in the casting fixture in spaced relation to the airfoil pattern on the supporting block. The angle of the airfoil pattern is adjusted within the casting fixture chamber relative to the locating block. A fixed mold is adapted to mate with the mold formed in the adjustable cast fixture and the two molds are placed on a lathe by means of the locating block set in one of the molds so that the surfaces for receiving the inner and outer shroud mold cavities can be formed. The molds are then matched with the inner and outer shroud cavities, and the wax or plastic pattern material is injected into the so-formed mold cavity for forming the investment pattern. When it is necessary to produce a new vane casting with modified stagger angle, it is necessary to re-orient the airfoil pattern in the casting fixture relative to the locating block.

12 Claims, 15 Drawing Figures

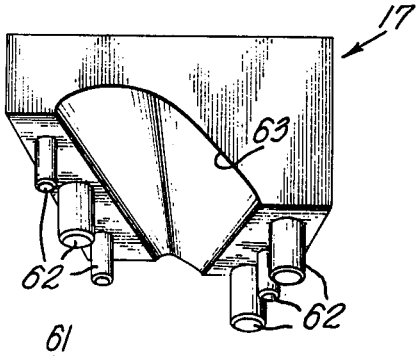
FIG.9
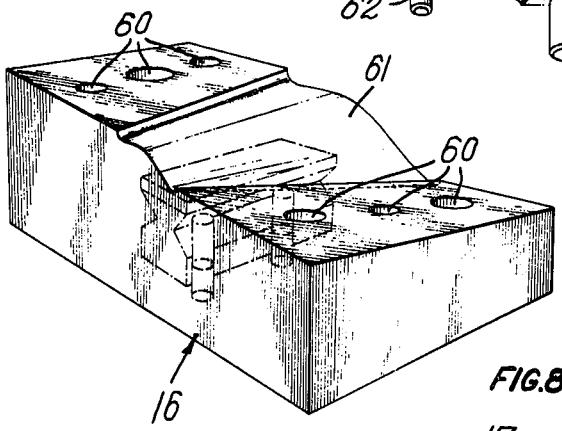
FIG.8
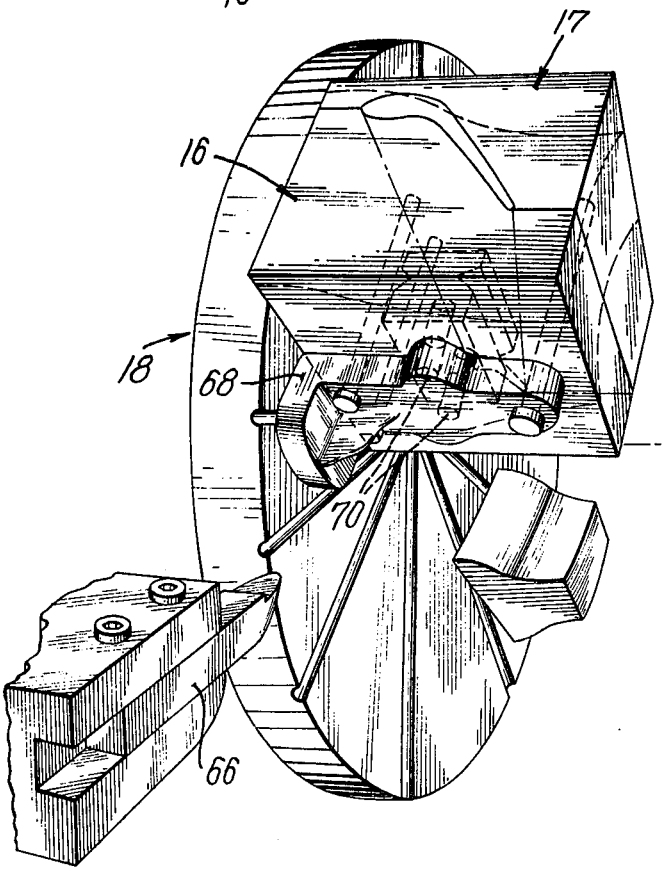
FIG.10
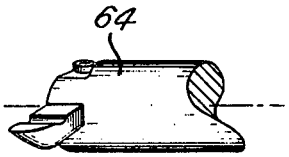

ADJUSTABLE TOOLING METHOD AND APPARATUS FOR INVESTMENT PATTERNS

BACKGROUND OF THE INVENTION

1. Field of the Invention

The present invention relates to mold making, and particularly to a method and apparatus for preparing a pre-investment pattern. More specifically, the present invention is related to the making of vane patterns for use in investment casting of annular stator vane rings, for instance, such as are used in gas turbine engines.

2. Description of the Prior Art

In the production development of any new gas turbine engine or in modification of any existing production engine, it is often necessary, in order to obtain optimum efficiency, to adapt the turbine nozzle section, that is, the throat area of the turbine stator vane ring to the prevailing conditions encountered when the engine is completed and tested. This requires modification of the vane stagger angle, shroud or vane spacing of each turbine stator due to manufacturing tolerances of the compressor, diffuser, etc. The throat area can be adjusted to a certain extent by casting excess metal in the nozzle sections between the vanes to allow for trimming. However, this allows adjustment only in one direction, that is, to increase the throat area. It also removes any protective coating. Another manner of modifying the throat area is to bend the airfoils of the vanes, but this can result in performance losses and/or turbine excitation problems. All of these suggested modifications are based on the correct assumption that the vanes are made by investment casting methods and that to modify the throat area of the vane ring by making pattern changes is prohibitively expensive and time consuming since the tooling to make the molds for the pre-investment patterns must be changed and so on.

SUMMARY OF THE INVENTION

It is an aim of the present invention to provide a flexible pre-investment pattern making tooling which will greatly reduce the cost and time for preparing such patterns.

It is a further aim of the present invention to provide flexible tooling for mold making such that when it is required to make a stator vane modification to adjust the throat area, a new mold for a new pre-investment pattern can be prepared without delay and at reasonable cost.

A construction in accordance with the present invention comprises a pre-investment pattern making mold made by adjustable mold making tooling. This tooling comprises a base, a fixing chamber formed on an area of the base, a locating means in said fixing chamber having indexing means adapted to be removably fitted to mating indexing means on said base, support means for supporting a representation of a form to be made in said fixing chamber, means for adjusting said representation of a form relative to said base and said locating means and means for spatially fixing the representation of form relative to the locating means.

More specifically, apparatus is used for making pre-investment patterns for stator vane rings and especially when an adjustment has to be made to a stator vane relative to its shroud platform to change the stagger angle thereof and a new pattern must be prepared. A mold piece is prepared in the fixing chamber by means of an airfoil vane pattern. The fixing chamber has walls, and the pattern has cylindrical projections extending co-axially with the stack axis of the vane journaled in the walls so that the angle of the airfoil can be set relative to the base and the locating block. The mold piece and locating block are adapted for matching with a companion airfoil mold piece and companion inner and outer shroud mold pieces, including inner and outer shroud cavities for matching with the so-formed airfoil mold in fixed relation to the locating block.

BRIEF DESCRIPTION OF THE DRAWINGS

Having thus generally described the nature of the invention, reference will now be made to the accompanying drawings showing by way of illustration an embodiment thereof, and in which:

FIG. 8 is a perspective view of the mold piece having a half airfoil cavity;

FIG. 9 is a mold piece having the other half airfoil cavity;

FIG. 10 is a perspective fragmentary view of the mold pieces mounted on a lathe;

DESCRIPTION OF THE PREFERRED EMBODIMENT

Figure 1:
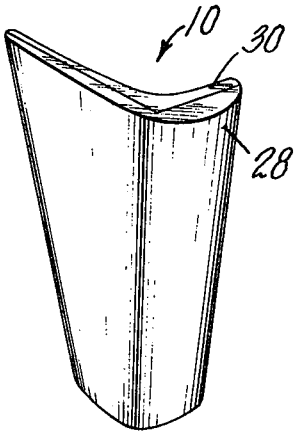
FIG. 1 is a perspective view of a typical pattern for the airfoil section of a vane.

Referring now to the drawings, a typical embodiment of an apparatus in accordance with the invention is illustrated. First of all, there is shown an airfoil section pattern 10 of a vane which must be machine made. One half of the airfoil pattern section is mounted and supported by a supporting block 12 which in turn is supported in the variable casting fixture 14 to form at least a half airfoil mold piece 16. The other airfoil mold piece 17 which mates with airfoil piece 16 is also cast. Companion molds, including inner shroud mold 20 and outer shroud mold 22, are also used with the mold pieces 16 and 17 to produce the final pre-investment vane molding 24.

Figure 2:
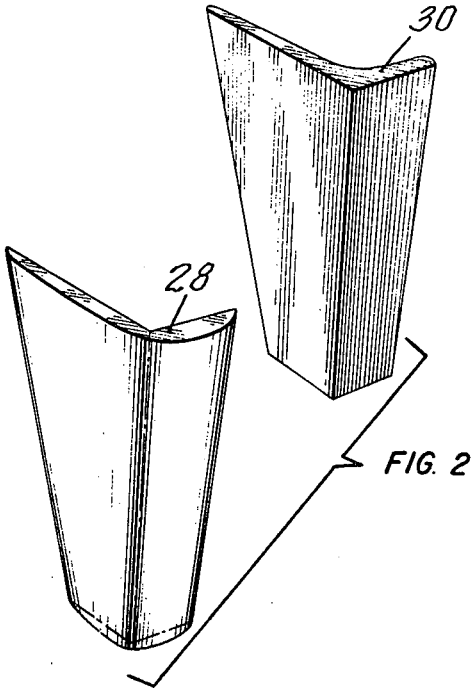
FIG. 2 is a perspective view showing the two split sections taken from the pattern of FIG. 1.

Referring now to FIGS. 1 and 2, a pattern of the airfoil section 10 is prepared and split to provide a convex airfoil half 28 and a concave airfoil half 30. Both of these airfoil halves 28 and 30 are mounted in respective support blocks for casting the mold pieces.

In the present embodiment, the convex airfoil pattern section 28 is cast conventionally. The concave airfoil section pattern 30 is mounted in the support block 12 which includes cylindrical extensions 32 and 34 having their axis of rotation aligned with the stack axis of the airfoil. To one of these cylindrical extensions 32 there is provided a sine-bar 38 extending therefrom. The supporting block 12 also mounts a plurality of dowels 36 which are adapted to provide corresponding openings in the casting.

Figure 3:
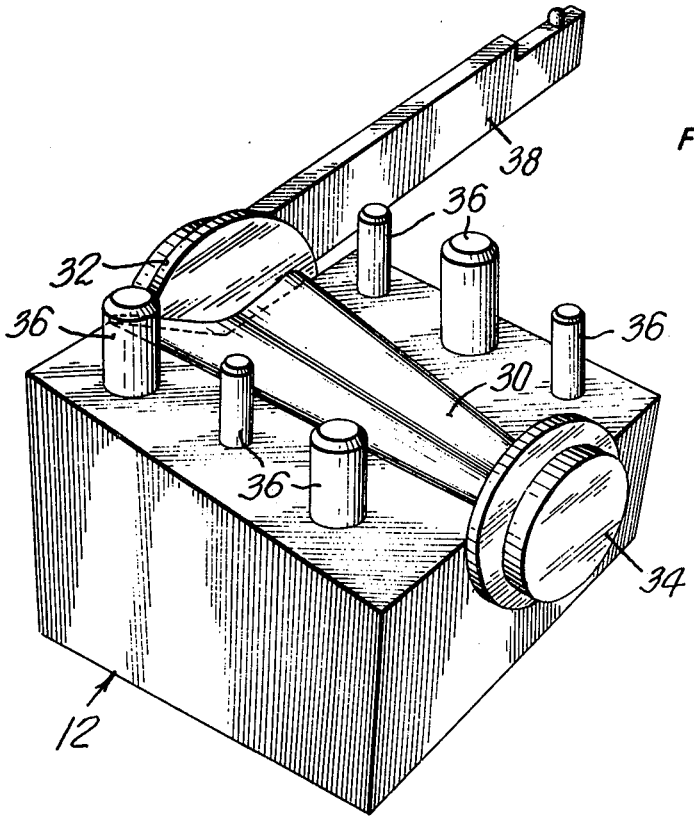
FIG. 3 is a perspective view of a typical mounting block for a half airfoil pattern.
Figure 4:
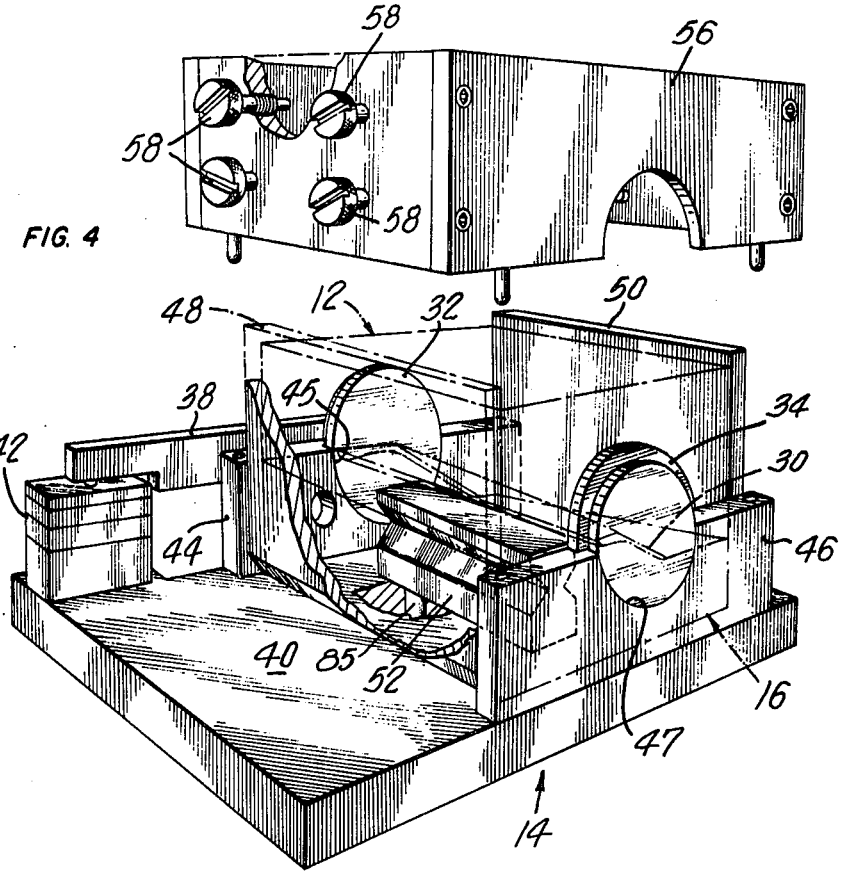
FIG. 4 is a perspective exploded view of the adjustable casting fixture.
Figure 5:
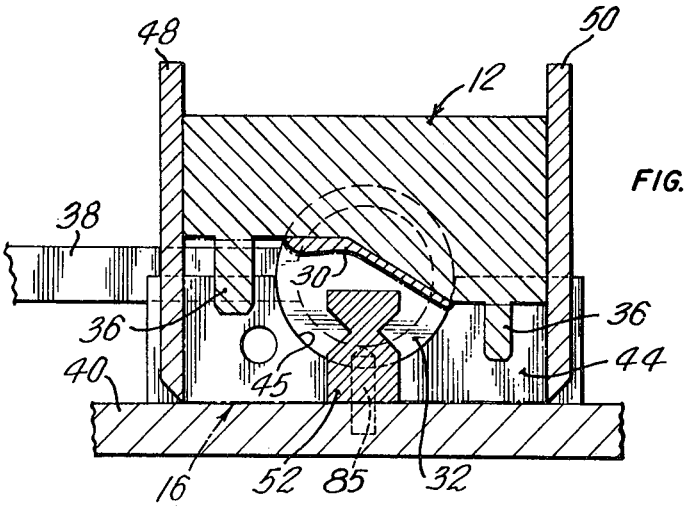
FIG. 5 is a vertical cross-section taken through the casting fixture of FIG. 4.

The supporting block 12 of FIG. 3 is then inserted in the casting fixture 14 with the cylindrical extensions 32 and 34 being seated in the semi-circular seats 45 and 47 provided in end walls 44 and 46. The fixture 14 includes a base 40. The gauge blocks 42 are mounted on the base 40 and are adapted to receive the end of the sine-bar 38 as will be described later. Side walls 48 and 50 complete the casting chamber. A locating block 52 is placed centrally of the casting chamber on the base and in spaced relation to the vane airfoil pattern 30. The locating block 52 is also provided with dowels 85 which are removably received in indexed holes in the base 40.

Devcon "C" cast epoxy can be used as the casting material at this point since it is the fastest and is most economical in providing the mold pieces 16 and 17. Sprayed metal or electroformed molds can be used for producing the mold piece cavities and can be produced from similar apparatus.

Figure 6:
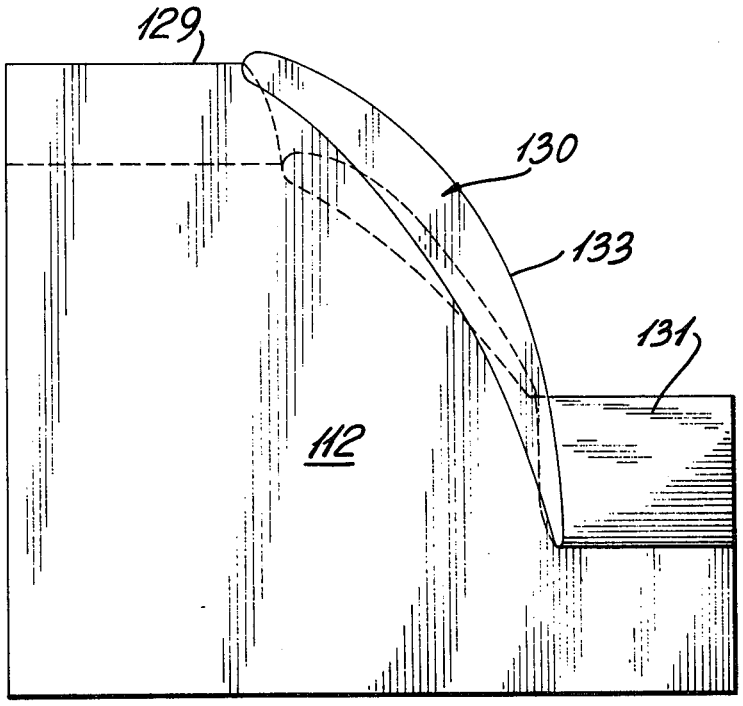
FIG. 6 is a perspective view of an embodiment of a mounting block for electroplating the airfoil.
Figure 7:
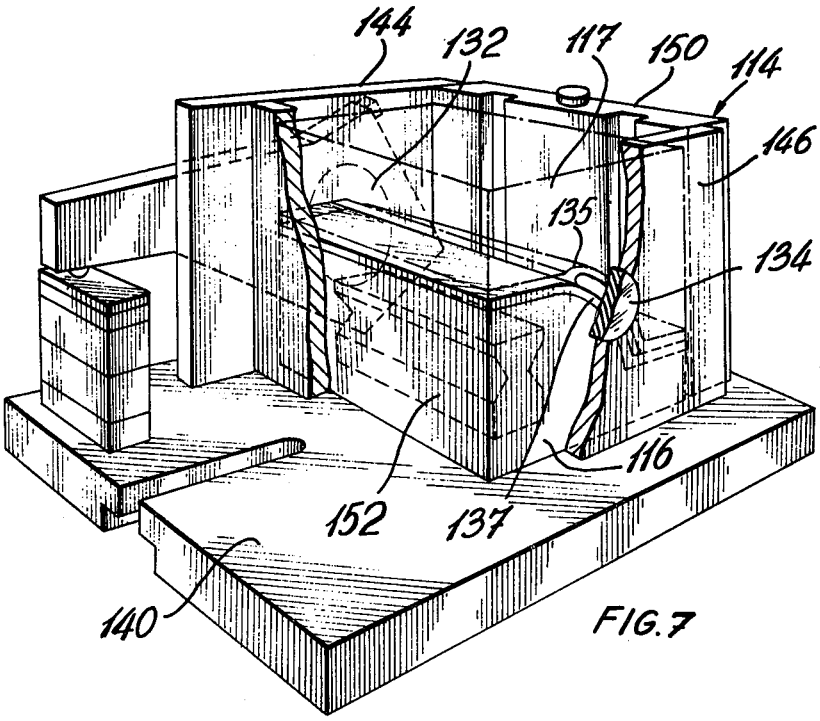
FIG. 7 is a perspective view of another embodiment of an adjustable casting fixture.
Figure 11:
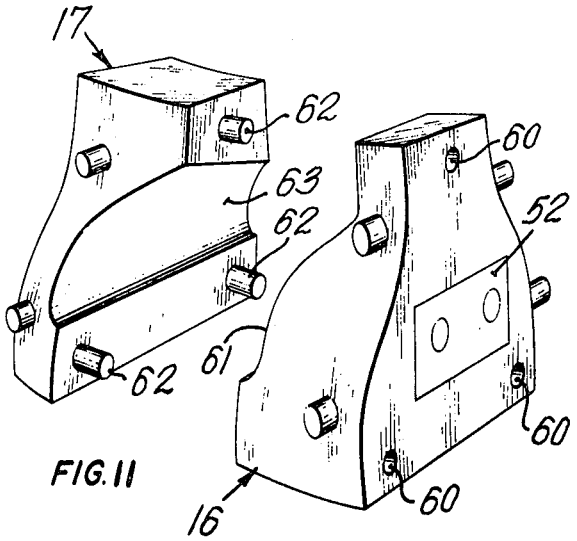
FIG. 11 is a perspective exploded view of the mold pieces after they have been machined.
Figure 12:
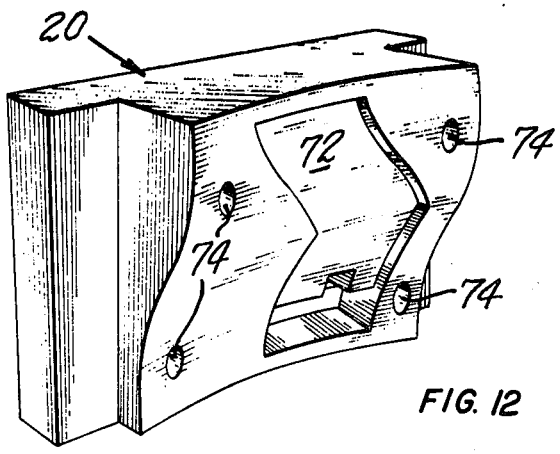
FIG. 12 is a perspective view of the mold piece for the inner shroud.
Figure 13:
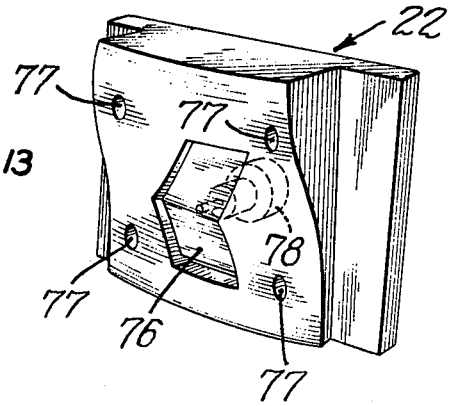
FIG. 13 is a perspective view of the mold piece for the outer shroud.
Figure 14:
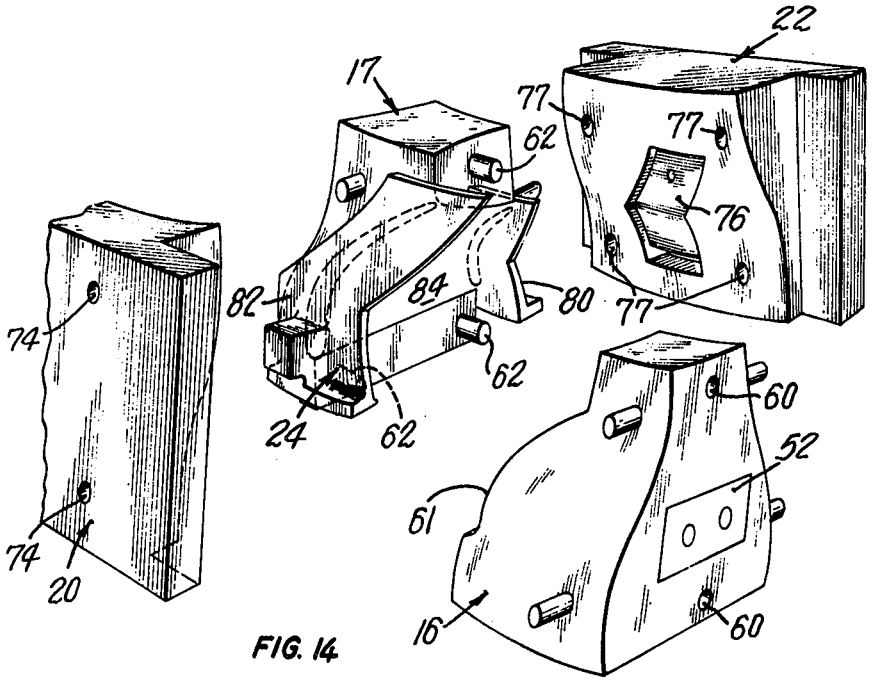
FIG. 14 is an exploded view of the mold pieces with the fabricated vane.
Figure 15:
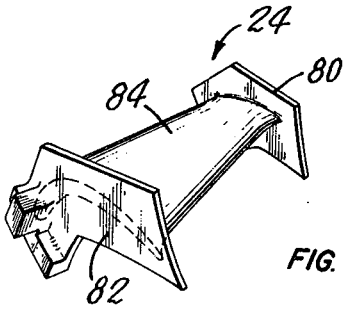
FIG. 15 is a perspective view of the vane pre-investment pattern.

In the case of electroforming it would not be necessary to split the airfoil pattern as described above. The master or patterned airfoil 130 is embedded in a suitable matrix 112 to the level of the parting surface of the mold as shown in FIG. 6. The master or pattern 130 thus embedded defines a convex cavity and the parting surfaces 129, 131. A metallic substance is then electroformed on the exposed surface of the airfoil pattern 130 and the parting surfaces 129, 131 formed by the matrix to produce a shell 135 defining a cavity and the adjacent parting surfaces. The concave cavity shell is formed by electroforming the metallic substance onto the previously formed convex shell 135 with the airfoil pattern still positioned in the cavity. The cavity shells 135, 137 can be provided with cooling tubes (not shown) electroformed in their backs. The cavity shells 135, 137 are oriented in the casting fixture 114.

The electroformed shells 135 and 137 are located on the master airfoil pattern 130 which is provided with end cylinders 132 and 134 and walls 144 and 146. A locating block 152 is provided in the space defined by the wall and left on the support surface 140. Suitable casting material is then poured into the chamber and is set about the shells 135, 137. Once the casting material is formed then the two pieces 116 and 117 are formed.

For the remainder of the description, reference will be made to previously described mold pieces 16 and 17. This is essentially the same process and can be carried out with the mold pieces 116 and 117.

The mold pieces 16 and 17 are then matched together by means of the apertures 60 and the dowels 62. The mold pieces 16 and 17 are then mounted on a lathe 18 shown in FIG. 8 and are oriented on the lathe by means of the support lathe fixture 68. Jig bored holes 70 are provided in the fixture 68 to receive the dowels from the locating block 52 formed in the mold piece 16. Accordingly, the lathe is rotated such that the turning tool 66 will profile the Devcon material from the mold piece 17 while at the same time the boring tool 64 will profile the Devcon casting material of the mold piece 16. If turning does not provide an adequate finish, milling or grinding in a rotatable fixture can be used to generate these surfaces in lieu of a lathe. Once the mold pieces 16 and 17 have been profiled, they are ready for matching with the companion molds 20 and 22 which are provided with cavities for forming the inner and outer shrouds respectively at each end of the airfoil section.

Finally, wax or plastic is injected by means of injection nozzle 78 into the mold cavities 61 and 63, 72 and 76 to form the completed vane pattern 24.

As is well known, the vane pattern 24 can now be used in an investment casting process.

In the preparation of a new engine, particularly where improvements or modifcations have been made to the engine, it is often necessary to test the engine and adjust the stagger angle of the stator vanes so as to obtain an optimum throat area. The adjustment can only be done by trial and error and, therefore, it may be necessary in the modification of a new engine to change the vane casting by varying the stagger angle of the airfoil 84 relative to the vane ring and, therefore, relative to the inner and outer shrouds 80 and 82. The pre-investment molding of the vane 24 can be, therefore, modified by adjusting the gauge blocks 42 in the preparation of a new vane molding 24 such that the angle of the vane airfoil pattern concave section 30 will be changed relative to the base 40 and, therefore, the locating block 52. The locating block 52 is the essential index of the orientation of the stagger angle of the airfoil 84. Since the shroud mold pieces 20 and 22 are not adjusted and since they match with the profiles of the mold pieces 16 and 17 in a constant manner and since the angle of the airfoil portion of the vane has been varied in the mold pieces 16 and 17 relative to the locating block 52, the angle will have been modified relative to the shrouds 80 and 82.

If it is necessary in the case of air-cooled vane rings to provide a steel core having a similar profile as the airfoil and to insert it in the airfoil cavity 61 and 63 when the mold pieces 16 and 17 are together, the core could be rotatably mounted to the mold piece 20 for one of the shrouds causing a hollow space to be formed within the vane in which cores can be inserted for investment casting. Of course the core must be adjusted angularly relative to the mold piece 20 corresponding to the angular adjustment of the airfoil.

I claim:

1. An apparatus for making a mold for pre-investment pattern, including a base, a locating means having indexing means adapted to be removably fitted to mating indexing means on said base, support means for supporting a representation of a form over said base, means for adjusting said representation of a form relative to said base and said locating means and means for spatially fixing said representation relative to said means.

2. An apparatus for making a pre-investment pattern as defined in claim 1, wherein a casting chamber is formed on an area on the base and the locating means includes a block in said casting chamber having indexing means, said support means supporting at least ½ of a pattern in said casting chamber, and means is provided for supplying casting material about the pattern in the locating block.

3. An apparatus as defined in claim 1, wherein the representation of form is an airfoil pattern which is embedded in a matrix up to the predetermined parting surfaces and each casting shell is electroformed on the pattern in the parting surfaces.

4. An apparatus as defined in claim 3, wherein a second shell is electroformed on the pattern and the first formed shell and a pair of shells are located in a casting chamber having the locating means in a form of a block that could be indexed to the base.

5. An apparatus as defined in claim 2, wherein the cast mold formed within the casting chamber and the locating block are adapted for matching with companion molds whereby the companion molds are fixed relative to the locating block but the cast mold cavity integral with the locating block may be adjusted relative to the companion molds.

6. An apparatus as defined in claim 5, wherein the pattern supported on said support means represents one-half of an airfoil for a stator vane for a gas turbine engine, said casting chamber is defined by walls on said base, the pattern and supporting means includes cylindrical projections extending co-axial with the stack axis of the vane to be formed, the supporting means includes a cylindrical projection being received by corresponding seats on the walls of the casting chamber adapted to be rotated about the stack axis of the vane such that the section of the vane can be set relative to the base and the locating block; the cast mold so formed and the locating block are adapted for matching with companion airfoil mold piece and companion inner and outer shroud mold pieces and include respective inner and outer shroud cavities for matching with the so-formed airfoil mold cavity in fixed relation to the locating block.

7. An apparatus as defined in claim 6, wherein the two cast mold pieces forming the airfoil section of the vane are machined on a lathe in order to form predetermined profile walls for matching with the inner and outer shroud mold pieces, the airfoil mold pieces being fixed on the lathe in a predetermined fixed relation relative to the locating block in one of the mold pieces.

8. An apparatus as defined in claim 6, wherein the resulting product of the casting of the assembled mold cavity is a stator vane including airfoil section and inner and outer shroud pieces suitable for use as a pattern in a pre-investment casting process.

9. An apparatus as defined in claim 7, wherein an arm is fixed to one of the cylindrical extensions on the supporting means and is adapted to be located relative to the base by means of the insertion of gauge blocks corresponding to the required angle of adjustment of the airfoil, between the arm and the base.

10. An apparatus as defined in claim 7, wherein the pre-casting pattern for the airfoil section of the vane is split so that one split section is provided on the supporting means used in the casting chamber while the other split pattern section is used for casting a mold cavity within a fixed casting chamber adapted to match with the cast mold formed in the adjustable casting chamber.

11. An apparatus as defined in claim 7, wherein the pattern section provided on the supporting means could be in the form of an electroformed shell formed about the pattern section with the shell adapted to be oriented relative to the locating block and the casting chamber and to be integrated with a mold casting block formed about the locating block in the shell.

12. A method of providing stator vane castings for a stator ring in a gas turbine engine, comprising the steps of forming a pattern of the airfoil section of the vane, providing separate inner and outer shroud mold cavities, splitting said pattern, mounting one of said split pattern sections on a support means, providing a casting chamber with a base, placing a locating block in the bottom of said casting chamber on said base in a predetermined position relative to the said base, orienting the support member with the split pattern section thereon in said casting chamber in a position relative to said locating block, pouring casting material into said casting chamber, removing said so-formed cast having a split pattern airfoil section cavity and the locating block, matching the so-formed cast mold with a companion mold made from the other split pattern airfoil section, mounting said assembled cast pieces on a lathe by means of said locating block and machining the cast material in the areas of the ends of the mold cavity so as to provide a suitable profile for receiving the inner and outer shroud mold cavities, matching the profiled mold pieces defining the airfoil section cavity with the mold pieces defining the inner and outer shroud cavities, pouring investment materials such as wax or investment plastic, into the so-formed mold cavity, separating the mold, investing the so-formed vane pattern, testing the vane in an assembled vane ring, preparing a new investment pattern on the basis of the data from the test by using the same split pattern on the support means and orienting the split airfoil pattern section in the said casting chamber relative to the locating block in response to the data acquired from the test, repeating the steps of matching and forming the pre-investment pattern, preparing a new investment cast vane and repeating the steps of this method until a suitable throat area and stagger angle of the stator vane ring is obtained.

* * * * *